US007485832B2

(12) United States Patent
Wang

(10) Patent No.: US 7,485,832 B2
(45) Date of Patent: Feb. 3, 2009

(54) METHOD AND CIRCUIT FOR PREVENTING OVER-HEAT OF HEAT-GENERATING DEVICE

(76) Inventor: Ching-Chuan Wang, 2 Fl., No. 33, Junhsien Rd., Chidu, Keelung (TW)

( * ) Notice: Subject to any disclaimer, the term of this patent is extended or adjusted under 35 U.S.C. 154(b) by 170 days.

(21) Appl. No.: 11/512,437

(22) Filed: Aug. 30, 2006

(65) Prior Publication Data

US 2008/0083734 A1 Apr. 10, 2008

(51) Int. Cl.
*H05B 1/02* (2006.01)

(52) U.S. Cl. ..... 219/482; 219/511; 219/517; 219/501

(58) Field of Classification Search ..... 219/511, 219/517, 209, 210, 494, 497, 501, 492, 507, 219/508

See application file for complete search history.

(56) References Cited

U.S. PATENT DOCUMENTS 3,924,214 A * 12/1975 Plasko ..... 337/163
5,618,460 A * 4/1997 Fowler et al. ..... 219/497
5,729,456 A * 3/1998 Boisvert et al. ..... 701/99
6,229,121 B1 * 5/2001 Jang et al. ..... 219/505
6,462,318 B2 * 10/2002 Furuuchi et al. ..... 219/517

* cited by examiner

*Primary Examiner*—Mark H Paschall
(74) *Attorney, Agent, or Firm*—Troxell Law Office, PLLC

(57) ABSTRACT

A method and a circuit for preventing over-heat of heat-generating device which are provided with a trigger circuit and a microprocessor on a heater circuit. And the trigger circuit is connected with a power source and a heat-generating device for heating the heat-generating device. The above-mentioned heater circuit is connected with a thermo fuse, a resistor and a reactive trigger circuit. Another end of the reactive trigger circuit is connected with the microprocessor for advancedly detecting whether the microprocessor is in abnormal condition. Once the microprocessor is damaged, the power source, the thermo fuse and the resistor make a loop and the resistor is heated to ruin the thermo fuse for terminating heating. Also, when the microprocessor works normally, the heater circuit and a switch for controlling temperature on reactive trigger circuit are detected to determine whether to terminate the heater circuit.

16 Claims, 3 Drawing Sheets

METHOD AND CIRCUIT FOR PREVENTING OVER-HEAT OF HEAT-GENERATING DEVICE

FIELD OF THE INVENTION

The present invention relates to a method and a circuit for preventing over-heat of heat-generating device and, more particularly, a method and a circuit for detecting advancedly abnormal situation of a microprocessor and a switch for temperature-controlling to terminate a heater circuit and preventing the heat-generating device from generating unusual high temperature. It is suitable for using on heat-generating devices, e.g. electric radiators or electric blankets.

DESCRIPTION OF THE PRIOR ART

The drawing of FIG. 3 illustrates a common electric blanket structure which has a set of stacked conducting sheets A1 in a cover bag. A plurality of ceramic resistors A2 is placed between every two conducting sheets A1 and flexible heat-resistant insulated member A3 is covered on every two conducting sheets A1 to form a heating plate A. The ceramic resistor A2 has a positive temperature coefficient (PTC). When two conducting sheets A1 are conducted electrically, the resistor value of PTC element will change steeply by temperature rising. When the resistor value is too large to cut the current-flow off, the circuit would be broken to achieve the purpose of controlling temperature.

The illustration of FIG. 4 shows in accordance with U.S. Pat. No. 5,861,610 a core element C wounded outside with a conducting wire C1 for heat generating, a second insulation layer C2, a sensing wire C3 and a first insulation layer C4. The sensing wire C3 is formed with PTC material (nickel alloy). No matter the temperature of the sensing wire C3 rises with the conducting wire C1 heating or the high temperature changes the resistance value of the sensing wire C3, the comparison is proceeded by comparative circuit in the controller. Then the inputted current value of conducting wire C1 is adjusted by the result of comparison to control heating temperature in the range of user's setting.

As above-mentioned, it is a common technique to use resistor wires for heating directly and controlling temperature by characters of PTC element or comparison of the sensing wire. But these ways to control temperature still have some problems:

1. No matter the way of using characters of PTC element or detecting comparison by sensing wire to achieve the purpose of controlling temperature, the adjustment is proceeded with temperature rising and stopped with temperature falling to normality. However, when users operate a heating pad, the temporary unusual high temperature under control wouldn't result in fire but have the risk to scald people.

2. The structure with sensing wire could achieve the purpose of controlling temperature by comparison. But when the controller is damaged and malfunctioned, the conducting wire for heating will be out of control and keep heating. The hazardous fire might happen.

Therefore, a novel circuit and a method for preventing over-heat of the heat-generating device are urged.

SUMMARY OF THE INVENTION

It is a main objective of the present invention to provide a method and a circuit for preventing over-heat of heat-generating device such that by operation of a microprocessor to respectively detecting the second switch of the trigger circuit and the first switch of the reactive trigger circuit of the heater circuit, the first and second switch are detected advancedly whether to work normally or not. When the abnormal signal is detected, the heating process is terminated to ensure the using safety.

It is a second objective of the present invention to provide a method and a circuit for preventing over-heat of heat-generating device which if the microprocessor for controlling temperature connected with the hot protection circuit is damaged, the thermo fuse will be ruined to terminate heating. Thus the abnormal condition of the microprocessor can be detected advancedly to prevent the heat-generating device from generating unusual high temperature and resulting in fire or burning users.

The present invention achieves the above-indicated objectives by providing a circuit comprising a heat-generating device, a heater circuit and a hot protection circuit. One end of the heat-generating device is connected with a power source and another end of that is electrically connected to ground. The heater circuit includes a trigger circuit and a microprocessor. The trigger circuit is connected with the power source and the heat-generating device. The microprocessor is connected with one end of the trigger circuit for controlling circuit conducting and heating the heat-generating device. The hot protecting circuit comprises a reactive trigger circuit, a resistor and a thermo fuse. The thermo fuse is connected with one end of the heat-generating device. Two ends of the resistor are connected with the reactive trigger circuit and the thermo fuse respectively. Another end of the reactive trigger circuit is connected with the microprocessor such that once the microprocessor stops signal outputting, the power source, the thermo fuse and the resistor make a loop and the resistor is heated to ruin the thermo fuse for terminating heating.

In practice, the trigger circuit of the heater circuit comprises a capacitor, a resistor and a second switch connecting in series. The second switch is preferably a bidirectional thyristor (TRIAC).

In practice, the microprocessor will stop signal outputting to the hot protection circuit when the second switch is short-circuited or the microprocessor is damaged.

In practice, the reactive trigger circuit comprises a first, a second and a third NPN bipolar transistors connected each other. A first and a second resistor-capacitor (RC) circuits are connected with the bases of the first and the second NPN bipolar transistors respectively. The first resistor-capacitor (RC) circuit is connected with the microprocessor and the emitters of the three NPN bipolar transistors are electrically connected to ground. The collectors of the three NPN bipolar transistors are connected with the rectified power source. A first switch is connected with the collector of the third NPN bipolar transistor and a resistor of the hot protection circuit respectively.

In practice, the first switch is preferably a bidirectional thyristor (TRIAC). One end of the first switch is connected with two resistors in parallel. The two resistors are connected with the microprocessor and another end of the first switch is connected with a resistor of the hot protection circuit.

A method for preventing over-heat of heat-generating device comprises following steps:

a. Providing a heat-generating device and a heater circuit, wherein one end of the heat-generating device is connected with a power source and another end of that is electrically connected to ground. The heater circuit comprises a trigger circuit and a microprocessor. The trigger circuit is connected with the power source and the heat-generating device. The microprocessor is connected with one end of the trigger circuit for controlling circuit conducting and heating the heat-generating device.

b. Providing a hot protection circuit comprising a reactive trigger circuit, a resistor and a thermo fuse. The thermo fuse is connected with one end of the heat-generating device. Two ends of the resistor are respectively connected with the reactive trigger circuit and the thermo fuse. Another end of the reactive trigger circuit is connected with the microprocessor such that once the microprocessor is damaged, the power source, the thermo fuse and the resistor make a loop and the resistor is heated to ruin the thermo fuse for terminating heating.

In practice, the trigger circuit of the heater circuit comprises a capacitor, a resistor and a second switch in series.

The above-mentioned method further comprises a step of detecting by a second switch such that the microprocessor stops outputting controlling pulse to the second switch of the trigger circuit of the heater circuit, by the response of the heater circuit the trigger circuit is known whether to be in normal condition or not and the microprocessor determines whether to terminate heating.

In practice, the reactive trigger circuit comprises a first, a second and a third NPN bipolar transistors that are connected each other. A first and a second resistor-capacitor (RC) circuit are respectively connected with the bases of the first and the second NPN bipolar transistors. The first resistor-capacitor (RC) circuit is connected with the microprocessor and the emitters of the three NPN bipolar transistors are electrically connected to ground. The collectors of the three NPN bipolar transistors are connected with the rectified power source. A first switch is connected with the collector of the third NPN bipolar transistor and a resistor of the hot protection circuit respectively. One end of the first switch is respectively connected with the microprocessor and a resistor of the hot protection circuit.

The above-mentioned method further comprises a step of detecting by a first switch such that the microprocessor stops outputting controlling pulse to the reactive trigger circuit and the second switch, by the response of the path between the first switch and the microprocessor the first switch is known whether to be in normal condition or not and the microprocessor determines whether to terminate heating.

BRIEF DESCRIPTION OF THE DRAWINGS

The present invention will be more fully understood when the following description is read in light of the accompanying drawings in which.

DETAILED DESCRIPTION OF THE PREFERRED EMBODIMENTS

Figure 1:
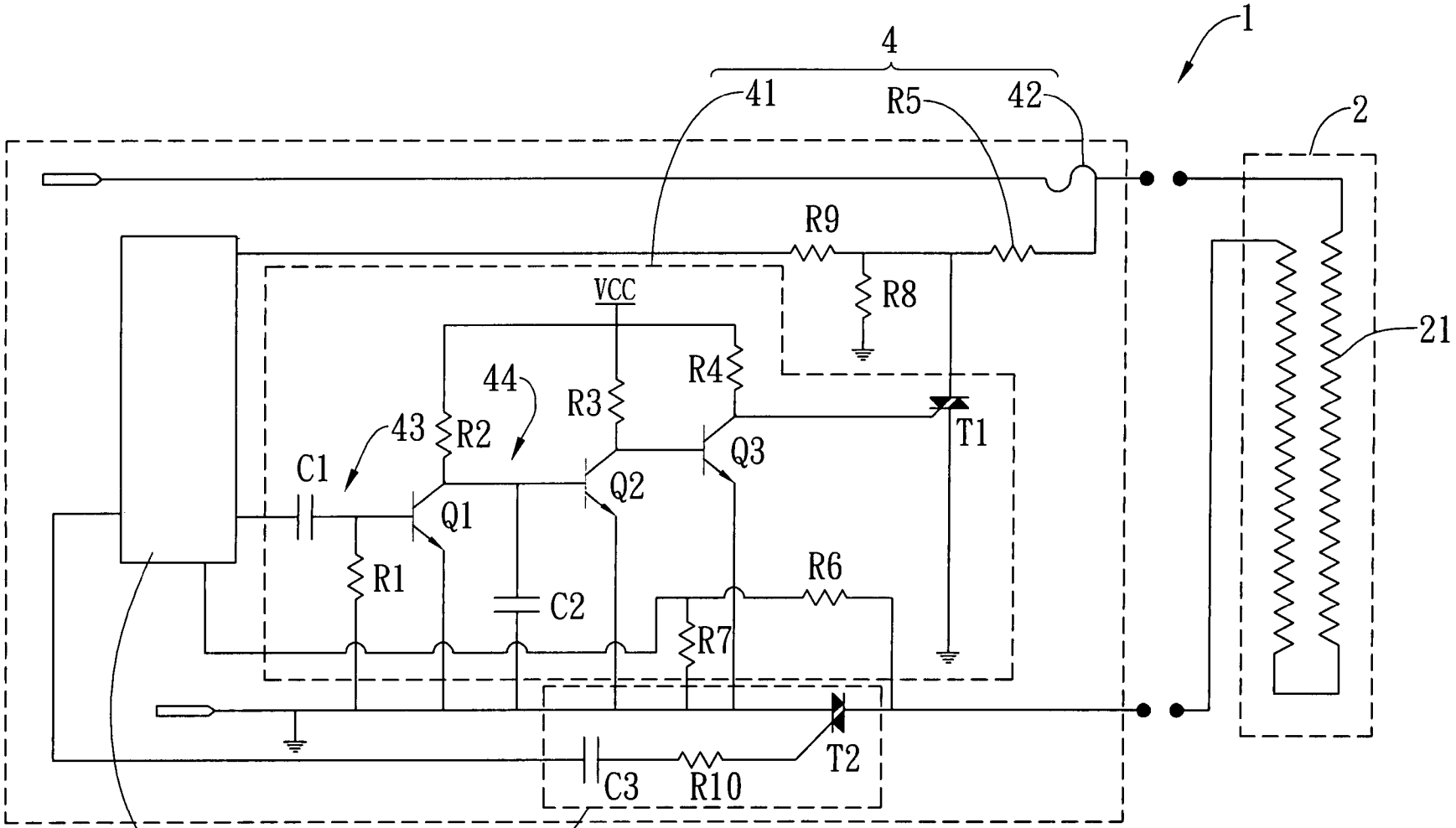
FIG. 1 is a circuit diagram of an embodiment of the present invention.

Referring to FIG. 1, it's a preferred embodiment of a circuit for preventing over-heat of heat-generating device in accordance with the present invention comprising a heat-generating device 2, a heater circuit 3, and a hot protection circuit 4.

The heat-generating device 2 mainly comprises an electric heater 21. One end of the heat-generating device 2 is connected with a power source and another end of that is electrically connected to ground.

The heater circuit 3 comprises a trigger circuit 31 and a microprocessor 32. The trigger circuit 31 comprises a capacitor C3, a resistor R10 and a second switch T2 connecting in series. The second switch T2 is a bidirectional thyristor (TRIAC). One end of the second switch T2 is electrically connected to ground and another end of that is connected with the heat-generating device 2 and the microprocessor 32. The second switch T2 is connected with two resistors (R6, R7) in parallel. One end of the capacitor C3 is connected with the microprocessor 32. When the microprocessor 32 outputs controlling signals, the second switch T2 is conducted to form a loop to heat the electric heater 21 of the heat-generating device 2. The trigger circuit 31 also could comprise a circuit of a relay (not shown in figures) to achieve the same effect of the heating heat-generating device 2.

The hot protection circuit 4 comprises a reactive trigger circuit 41, a resistor R5 and a thermo fuse 42. One end of the thermo fuse 42 is connected with the heat-generating device 2 and another end of that is connected with the power source. Two ends of the resistor R5 are connected with the reactive trigger circuit 41 and the thermo fuse 42. The reactive trigger circuit 41 comprises a first, a second and a third NPN bipolar transistors (Q1, Q2, Q3). The base of the first NPN bipolar transistor Q1 is connected with a first resistor-capacitor (RC) circuit 43. The capacitor C1 of the RC circuit 43 is connected with the microprocessor 32. The collector of the first NPN bipolar transistor Q1 is connected with a second RC circuit 44 and the base of the second NPN bipolar transistor Q2. The collector of the second NPN bipolar transistor Q2 is connected with a resistor R3 and the base of the third NPN bipolar transistor Q3. The collector of the third NPN bipolar transistor Q3 is connected with a resistor R4 and a bidirectional thyristor (TRIAC). The bidirectional thyristor is as a first switch T1. One end of the first switch T1 is electrically connected to ground and another end of that is connected with the resistor R5 of the hot protection circuit 4. The emitters of the first, second and third NPN bipolar transistors (Q1, Q2, Q3) are respectively electrically connected to ground. The resistor R2 of the second RC circuit and two resistors (R3, R4) respectively connected with the collectors of the second and the third NPN bipolar transistor (Q2, Q3) are connected with a rectified power source (Vcc)(5V) in the meantime.

Moreover, one end of the first switch T1 is connected with a resistor R5 of the hot protection circuit 4 and meanwhile connected with two resistors (R8,R9) in parallel. A resistor R9 is connected with the microprocessor 32 and another resistor R9 is electrically connected to ground.

In this embodiment, when the microprocessor 32 is in normal working situation, it sends out controlling signals of frequency 50~60 Hz to the trigger circuit 31 for the electric heater 21 of the heat-generating device 2 heating normally, on one hand, and by the first RC circuit 43 forming pulse through the base of the first NPN bipolar transistor Q1 to control whether the collector and the emitter of the first NPN bipolar transistor Q1 is conducted or not, on the other hand. When the controlling signals of the microprocessor 32 have a high-leveled output through capacitor C1, the collector and the emitter of the first NPN bipolar transistor Q1 will be in the on-state. The current flows through Vcc to ground. Meanwhile, the capacitor C2 of the second RC circuit 44 is discharged. The low voltage of the collector of the first NPN bipolar transistor Q1 makes the collector and the emitter of the second RC bipolar transistor Q2 off. When the current of Vcc (5V) passes through the resistor R3 to the base of the third NPN bipolar transistor Q3, the collector and the emitter of the third NPN bipolar transistor Q3 will be in the on-state. The current passes through Vcc to ground. The low voltage of the collector of the third NPN bipolar transistor Q3 makes the first switch T1 off.

When the output of the controlling signals sent out through the capacitor C1 by the microprocessor 32 is in low level, the collector and the emitter of the first NPN bipolar transistor Q1 is in the off-state and the capacitor C2 of the second RC circuit 44 starts charging. After the charge of the capacitor C2 is finished, the second NPN transistor Q2 would turn on. In practice of the present invention, by enlarging the value of the capacitor C2 or reducing the value of the resistor R2 to adjust the second RC circuit 44 properly, the capacitor C2 would keep charging and being late for full charged in the range of the time coefficient of the second RC circuit 44. In other words, keeping inputting controlling signals of frequency 50~60 Hz makes the voltage of the base of the second NPN bipolar transistor Q2 lower than 0.7V. Then the collector and the emitter of the second NPN bipolar transistor Q2 would turn off and the first switch T1 maintains in the off-state.

When the microprocessor 32 works normally and detects the trigger circuit T2 short-circuited or the microprocessor 32 is down or damage, the microprocessor 32 stops outputting the controlling signals of frequency 50~60 Hz to control the base of the first NPN bipolar transistor Q1. Meanwhile, the low voltage inputted into the base of the first NPN bipolar transistor Q1 makes the collector and the emitter of the second NPN bipolar transistor Q2 off. The high voltage (5V) of the collector of the second RC transistor Q1 would continue charging the capacitor C2 of the second RC circuit 44. Full charge would turn the collector and the emitter of the second NPN bipolar transistor Q2 on. The low voltage (0V) of the collector of the second NPN bipolar transistor Q2 would turn the collector and the emitter of the third NPN bipolar transistor Q3 off. The current of Vcc (5V) passes through the collector of the third NPN bipolar transistor Q3 to the first switch T1. Then the first switch T1 turns on and makes the resistor R5 heated. When the temperature of the resistor R5 is higher than the melting temperature of the thermo fuse 42, the thermo fuse 42 melts to break the loop of the heater circuit 3 at the same time. The microprocessor 32 supplied current by the power source controls the LED or monitor to show the message of circuit breaking (not shown in figures).

Figure 2:
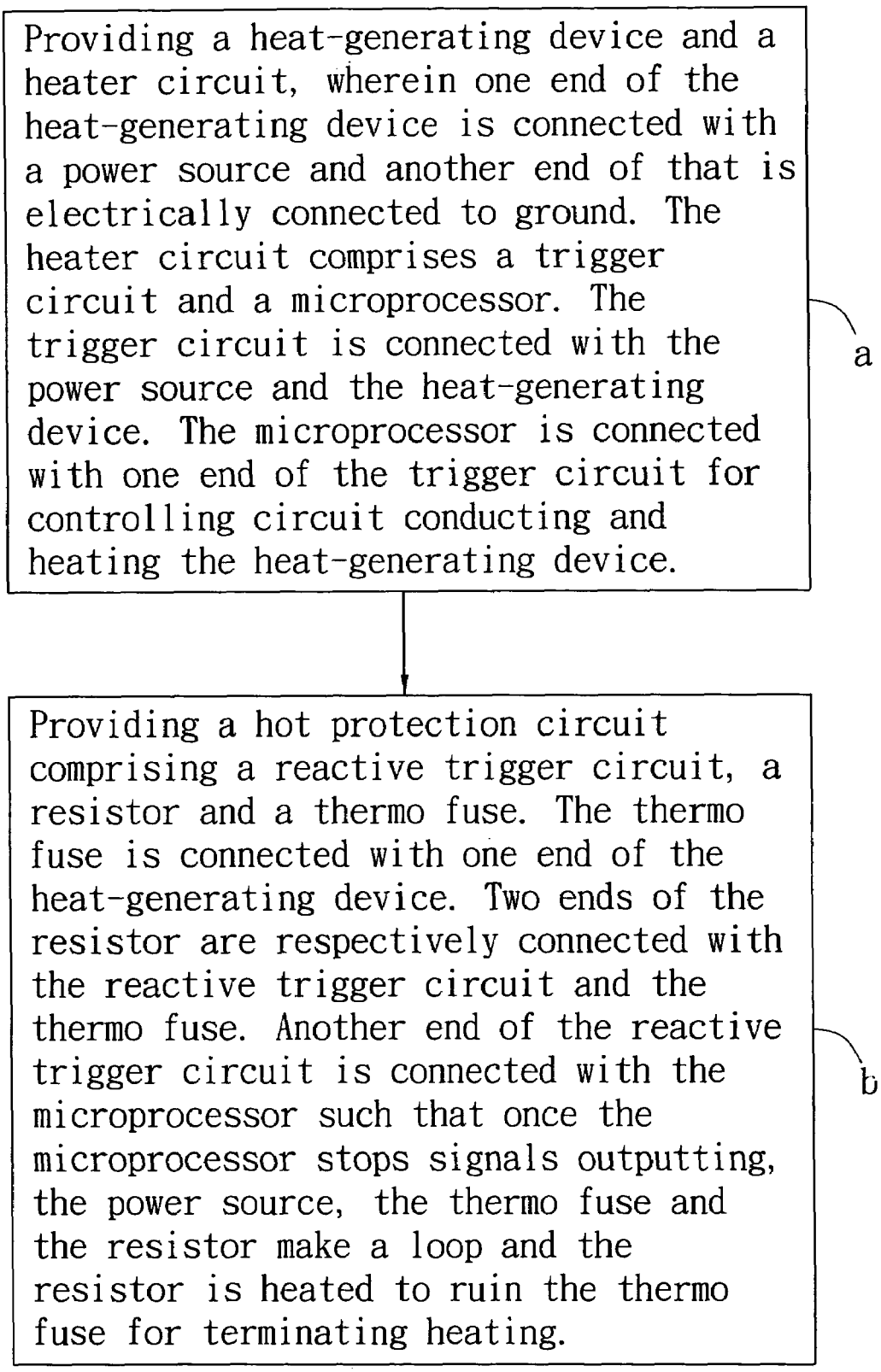
FIG. 2 is a block diagram of an embodiment of the present invention.
Figure 3:
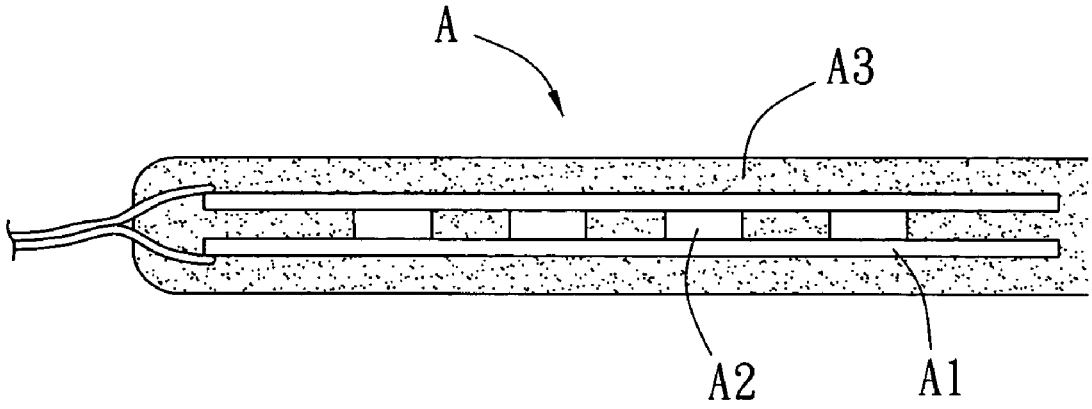
Fig. 3 (Prior Art)
FIG. 3 is a cross-sectional view of the heating pad in the prior art.
Figure 4:
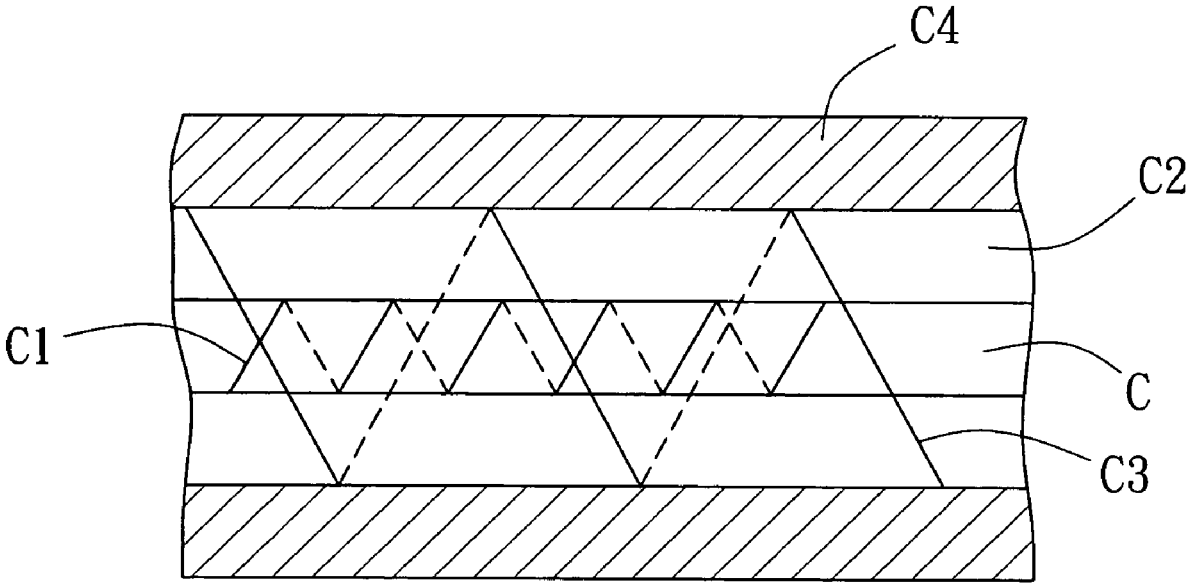
Fig. 4 (Prior Art)
FIG. 4 is a cross-sectional view of the heating wire in accordance with U.S. Pat. No. 5,861,610 in the prior art.

Referring to both FIGS. 1 and 2, the method for preventing over-heat of heat-generating device of the present invention comprises following steps:

a. Providing a heat-generating device 2 and a heater circuit 3, wherein one end of the heat-generating device is connected with a power source and another end of that is electrically connected to ground. The heater circuit 3 comprises a trigger circuit 31 and a microprocessor 32. The trigger circuit 31 is connected with the power source and the heat-generating device 2. The microprocessor 32 is connected with one end of the trigger circuit 31 for controlling circuit conducting and heating the heat-generating device 2.

b. Providing a hot protection circuit 4 comprising a reactive trigger circuit 41, a resistor R5 and a thermo fuse 42. The thermo fuse 42 is connected with one end of the heat-generating device 2. Two ends of the resistor R5 are respectively connected with the reactive trigger circuit 41 and the thermo fuse 42. Another end of the reactive trigger circuit 41 is connected with the microprocessor 32 such that once the microprocessor 32 stops signals outputting, the power source, the thermo fuse 42 and the resistor R5 make a loop and the resistor R5 is heated to ruin the thermo fuse 42 for terminating heating.

In practice, besides the above-mentioned method of detecting microprocessor 32, the present invention further comprises a step of detecting by a second switch T2 for stopping the microprocessor 32 outputting controlling pulse to the second switch T2 of the trigger circuit 31 of the heater circuit 3. In other words, when the second switch T2 is in the off-state, the microprocessor 32 detects one end of the trigger circuit 31 is in high level during normal condition. If the microprocessor 32 detects that one end of the trigger circuit 31 is in low level and then realizes that the trigger circuit T2 is short-circuited, the microprocessor 32 stops sending the controlling signals of frequency 50-60 Hz to terminate heating process for preventing the heat-generating device 2 from keeping heating and resulting in extraordinary high temperature.

Furthermore, the present invention further comprises a step of detecting by a first switch T1 for stopping the microprocessor 32 outputting controlling pulse to the reactive trigger circuit 41 and the second switch T2 and simultaneously detecting the voltage of the path between the first switch T1 and the microprocessor 32. When the first switch T1 is in the on-state normally, the voltage of the path between the first switch T1 and the microprocessor 32 should be in the low-state. When the first switch T1 is in the off-state normally, the voltage between the first switch T1 and the microprocessor 32 should be in the high-state. If the voltage is low, that means the first switch T1 has been damaged, i.e. is in the on-state. Meanwhile, the microprocessor 32 terminates the heating process immediately. After the reactive trigger circuit 41 is recovered, it will keep working normally and detecting the working condition of the microprocessor 32 at any moment. Thus, the present invention has following advantages:

1. When the microprocessor works normally in accordance with the present invention, the first and second switch are respectively detected whether to work normally or not to prevent the short circuit of the second switch and the off-state of the first switch. It makes sure the user's safety.
2. The present invention could pre-detect the abnormal condition of the microprocessor to terminate heating to prevent fire effectively and avoid the heat-generating device generating extra-high temperature to scald users.

While the invention has been particularly shown and described with reference to preferred embodiments thereof, it will be understood by those skilled in the art that various changes in form and details may be made without departing from the spirit and scope of the invention.

The invention claimed is:

1. A circuit for preventing over-heat of heat-generating device comprising:

a heat-generating device, wherein one end of the heat-generating device is connected with a power source and another end of that is electrically connected to ground;

a heater circuit comprising a trigger circuit and a microprocessor, wherein the trigger circuit is connected with the power source and the heat-generating device and the microprocessor is connected with one end of the trigger circuit for controlling circuit conducting and heating the heat-generating device; and a hot protecting circuit comprising a reactive trigger circuit, a resistor and a thermo fuse, wherein the thermo fuse is connected with one end of the heat-generating device; two ends of the resistor are connected with the reactive trigger circuit and the thermo fuse respectively; another end of the reactive trigger circuit is connected with the microprocessor such that once the microprocessor stops signals outputting, the power source, the thermo fuse and the resistor make a loop and the resistor is heated to ruin the thermo fuse for terminating heating.

2. The circuit as claimed in claim 1, wherein the trigger circuit of the heater circuit comprises a capacitor, a resistor and a second switch connecting in series.

3. The circuit as claimed as in claim 2, wherein the second switch is a bidirectional thyristor (TRIAC).

4. The circuit as claimed in claim 2, wherein one end of the second switch is electrically connected to ground and another end of that is connected with the heat-generating device and the microprocessor; the second switch is connected with two resistors in parallel.

5. The circuit as claimed in claim 4, wherein the microprocessor stops outputting signals to the hot protection circuit when the second switch is short-circuited.

6. The circuit as claimed in claim 1, wherein the microprocessor stops outputting signals to the hot protection circuit when it is damaged.

7. The circuit as claimed in claim 1, wherein the reactive trigger circuit comprises a first, a second and a third NPN bipolar transistors that are connected each other; a first and a second resistor-capacitor (RC) circuits are connected with the bases of the first and the second NPN bipolar transistors respectively; the first resistor-capacitor (RC) circuit is connected with the microprocessor and the emitters of the three NPN bipolar transistors are electrically connected to ground; the collectors of the three NPN bipolar transistors are connected with the rectified power source; a first switch is connected with the collector of the third NPN bipolar transistor and a resistor of the hot protection circuit respectively.

8. The circuit as claimed in claim 7, wherein the first switch is a bidirectional thyristor (TRIAC).

9. The circuit as claimed in claim 7, wherein one end of the first switch is connected with two resistors in parallel; the two resistors are connected with the microprocessor and another end of the first switch is connected with a resistor of the hot protection circuit.

10. A method for preventing over-heat of heat-generating device comprises following steps:

a. providing a heat-generating device wherein one end of the heat-generating device is connected with a power source and another end of that is electrically connected to ground; and a heater circuit comprising a trigger circuit and a microprocessor; the trigger circuit is connected with the power source and the heat-generating device; the microprocessor is connected with one end of the trigger circuit for controlling circuit conducting and heating the heat-generating device; and b. providing a hot protection circuit comprising a reactive trigger circuit, a resistor and a thermo fuse; the thermo fuse is connected with one end of the heat-generating device; two ends of the resistor are respectively connected with the reactive trigger circuit and the thermo fuse; another end of the reactive trigger circuit is connected with the microprocessor such that once the microprocessor stops outputting signals, the power source, the thermo fuse and the resistor make a loop and the resistor is heated to ruin the thermo fuse for terminating heating.

11. The method as claimed as in claim 10, wherein the trigger circuit of the heater circuit comprises a capacitor, a resistor and a second switch connecting in series.

12. The method as claimed in claim 10, further comprising a step of detecting by a second switch such that the microprocessor stops outputting controlling pulse to the second switch of the trigger circuit of the heater circuit, by the response of the heater circuit, the trigger circuit is known whether to be in normal condition or not and the microprocessor determines whether to terminate heating.

13. The method as claimed in claim 10, wherein the reactive trigger circuit comprises a first, a second and a third NPN bipolar transistors that are connected each other; a first and a second resistor-capacitor (RC) circuit are respectively connected with the bases of the first and the second NPN bipolar transistors, the first resistor-capacitor (RC) circuit is connected with the microprocessor and the emitters of the three NPN bipolar transistors are electrically connected to ground; the collectors of the three NPN bipolar transistors are connected with the rectified power source; a first switch is connected with the collector of the third NPN bipolar transistor and a resistor of the hot protection circuit respectively.

14. The method as claimed in claim 13, wherein one end of the first switch is respectively connected with the microprocessor and a resistor of the hot protection circuit.

15. The method as claimed in claim 14, further comprising a step of detecting by a first switch such that the microprocessor stops outputting controlling pulse to the reactive trigger circuit and the second switch, by the response of the path between the first switch and the microprocessor the first switch is known whether to be in normal condition or not and the microprocessor determines whether to terminate heating.

16. The method as claimed in claim 10, wherein the microprocessor stops outputting signals to the hot protection circuit when it is damaged.

* * * * *